United States Patent [19]

Griffith

[11] 4,053,007

[45] Oct. 11, 1977

[54] ANIMAL ACCESS DOOR FOR SCREEN DOORS

[76] Inventor: Raymond E. Griffith, 2333 Hopeton Ave., San Jose, Calif. 95122

[21] Appl. No.: 539,700

[22] Filed: Jan. 9, 1975

[51] Int. Cl.[2] ..... E06B 7/28

[52] U.S. Cl. ..... 160/180; 160/354; 49/168

[58] Field of Search ..... 160/180, 181, 354; 49/171, 169

[56] References Cited

U.S. PATENT DOCUMENTS

| | | | |
|---|---|---|---|
| 550,995 | 12/1895 | Mueller | 49/169 |
| 704,992 | 7/1902 | Warner | 160/180 |
| 783,083 | 2/1905 | Small | 160/180 |
| 1,025,721 | 5/1912 | Raney | 160/180 |
| 1,472,663 | 10/1923 | Miller | 49/171 |
| 1,684,027 | 9/1928 | Hinman | 160/180 |
| 1,704,157 | 5/1929 | Webber | 160/180 |
| 1,721,223 | 7/1929 | Kern | 49/169 |
| 1,753,683 | 4/1930 | Blackburn | 160/354 |
| 1,827,353 | 10/1931 | Card, Jr. | 160/180 |
| 2,758,646 | 8/1956 | Johnson | 160/354;90 |
| 2,778,417 | 1/1957 | Novitz | 160/354 |
| 3,464,158 | 9/1969 | Greene | 49/168 |
| 3,690,299 | 9/1972 | Johnson | 160/354 |
| 3,811,224 | 5/1974 | Garrison | 160/180 |

FOREIGN PATENT DOCUMENTS

| | | | |
|---|---|---|---|
| 1,213,702 | 4/1960 | France | 160/354 |

OTHER PUBLICATIONS

Popular Mechanics, 12/1962, p. 147.

*Primary Examiner*—Paul R. Gilliam
*Assistant Examiner*—Victor N. Sakran
*Attorney, Agent, or Firm*—John J. Leavitt

[57] ABSTRACT

Presented is a screen door structure embodying a smaller animal access door through which animals may pass through the screen door while still providing protection against flying insects.

1 Claim, 4 Drawing Figures

ANIMAL ACCESS DOOR FOR SCREEN DOORS

BACKGROUND OF THE INVENTION

This invention relates to doors for dwellings embodying animal access doors through which an animal may pass into and out of the dwelling, and relates particularly to primary screen doors which embody such auxiliary animal access doors.

A search of the prior art has indicated that animal access doors for use in conjunction with solid doors for dwellings are known. Examples of animal access doors in solid doors are shown in U.S. Pat. Nos. 2,758,646; 2,778,417; 3,690,299 and 3,797,554. However, it is surprising that the prior art has not revealed the use of an animal access door in conjunction with a screen door. Accordingly, it is one of the objects of the present invention to provide a screen door structure embodying an auxiliary animal access door.

Another object of the invention is the provision of an animal access door kit for screen doors which may be purchased as a separate item and which may be easily mounted on an existing screen door by the consumer, thus precluding the necessity of purchasing a new screen door embodying the animal access door.

The invention possesses other objects and features of advantage, some of which, with the foregoing, will be apparent from the following description and the drawings. It is to be understood however, that the invention is not limited to the embodiment illustrated and described, since it may be embodied in various forms within the scope of the appended claims.

SUMMARY OF THE INVENTION

In terms of broad inclusion, one aspect of the invention comprises a primary screen door structure in the lower portion of which, either adjacent one vertical edge or centrally disposed adjacent the lower edge, there is provided a relatively small opening closed by an appropriately sized auxiliary door, and constructed in such a manner that an animal may pass freely from one side of the primary screen door to the other through the opening and past the small access door. The auxiliary access door closing the small opening is constructed in such a way that the animal access door always returns to a closed position once the animal has passed through. In another aspect, the invention comprises an animal access door kit which may be manufactured and purchased as a separate entity apart from the primary screen door on which it is adapted to be applied. In this aspect of the invention, the animal access door kit or assembly comprises an elongated beam or rail adapted across the width of the primary screen door on which it is to be applied, and a vertical stringer disposed between the rail and the lower edge portion of the primary screen door. The transversely extending rail and vertical stringer define an area of the primary screen door from which the screen may be cut to provide an opening. The opening is then closed by an appropriately sized auxiliary animal access door structure that is pivotally mounted between the vertical stringer and the door frame so that it lies in the same plane as the primary screen door.

DESCRIPTION OF THE PREFERRED EMBODIMENT

Figure 1:
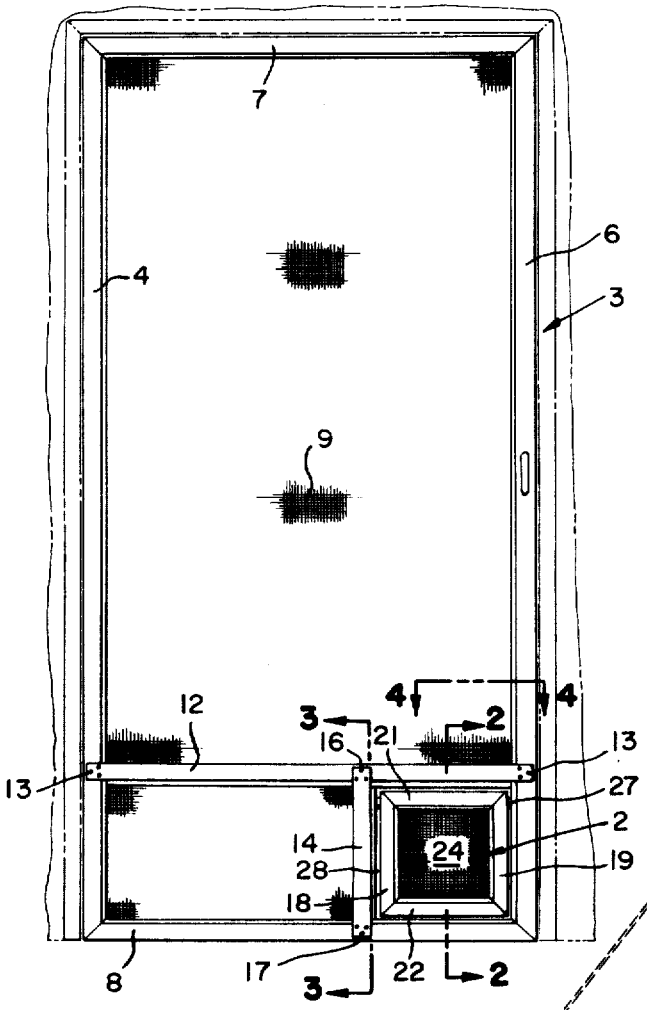
FIG. 1 is a front elevational view showing a completed primary screen door with the auxiliary animal access door attached thereto.

In terms of greater detail, the auxiliary animal access door for a primary screen door forming the subject matter of this invention is illustrated in FIG. 1 in association with a primary screen door, and as there shown, the auxiliary animal access door is designated generally by the numeral 2, and is positioned so as to occupy the lower corner of the primary screen door which is designated generally by the numeral 3. As with most conventional screen doors, the primary screen door is provided with vertical side rails 4 and 6, a top rail 7, a bottom rail 8, and between which rails there is stretched a length of screen material 9. The screen may be either of the woven wire variety, or it may be one of the synthetic resin materials woven to simulate woven wire screen.

The auxiliary animal access door assembly includes a top mounting rail 12, adapted to extend transversely between the side rails 4 and 6 of the primary screen door and to be attached thereto by appropriate sheet metal screws 13. Additionally, the midportion of the top mounting rail 12 of the auxiliary access door assembly is supported and strengthened by a vertical rail 14 secured to the top mounting rail 12 by appropriate sheet metal screws 16 and secured also to the bottom rail 8 of the primary screen door by appropriate sheet metal screws 17. Within the space defined by the vertical rail 14, the complementary portion of the side rail 6, the top mounting rail 12 disposed between the vertical rail 14 and the side rail 6 and the complementary portion of bottom rail 8 is defined a generally rectangular or square area of the primary screen door within which the auxiliary animal access door is adapted to fit.

The auxiliary access door is provided with side rails 18 and 19, a top rail 21 and a bottom rail 22. Each of the side, top and bottom rails of the auxiliary access door are provided with peripheral flanges 23 which cooperate with the associated rail to form a channel or groove 23' within which the peripheral edge of a screen section 24 is inserted, to be held therein by a resilient seal strip 26 which is also squeezed into the channel 23' between the associated edge portion of the screen and the associated rail so as to lock the screen thereto.

To pivotally mount the auxiliary animal access door 2 in the opening defined by the rails 6, 8, 12 and 14 or portions thereof which define the opening into which it fits, there is provided an elongated rod 27 that extends longitudinally through the top rail 21 of the auxiliary access door and which has opposite ends journaled on the one hand on the vertical rail 14 as shown, and on the other hand on the side rail 6 of the primary screen door. It will thus be seen that since the pivotal rod 27 is centrally disposed with respect to the supporting rails 14 and 6, and since most of the weight of the auxiliary animal access door 2 lies below the pivotal axis formed by the rod 27, the auxiliary animal access door may swing in both directions out of the plane of the primary screen door in which it is mounted. Thus, the auxiliary door provides access through the primary screen door from both sides thereof and always returns to a closed position after an animal has passed through.

Figure 3:
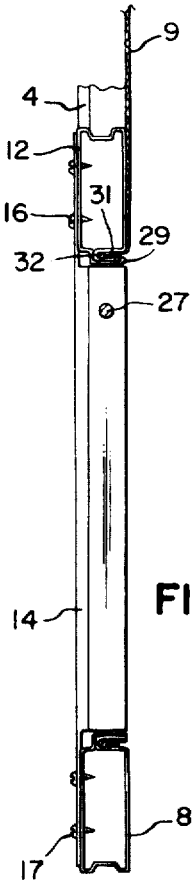
FIG. 3 is a fragmentary vertical sectional view taken in the plane indicated by the line 3—3 in FIG. 1.
Figure 2:
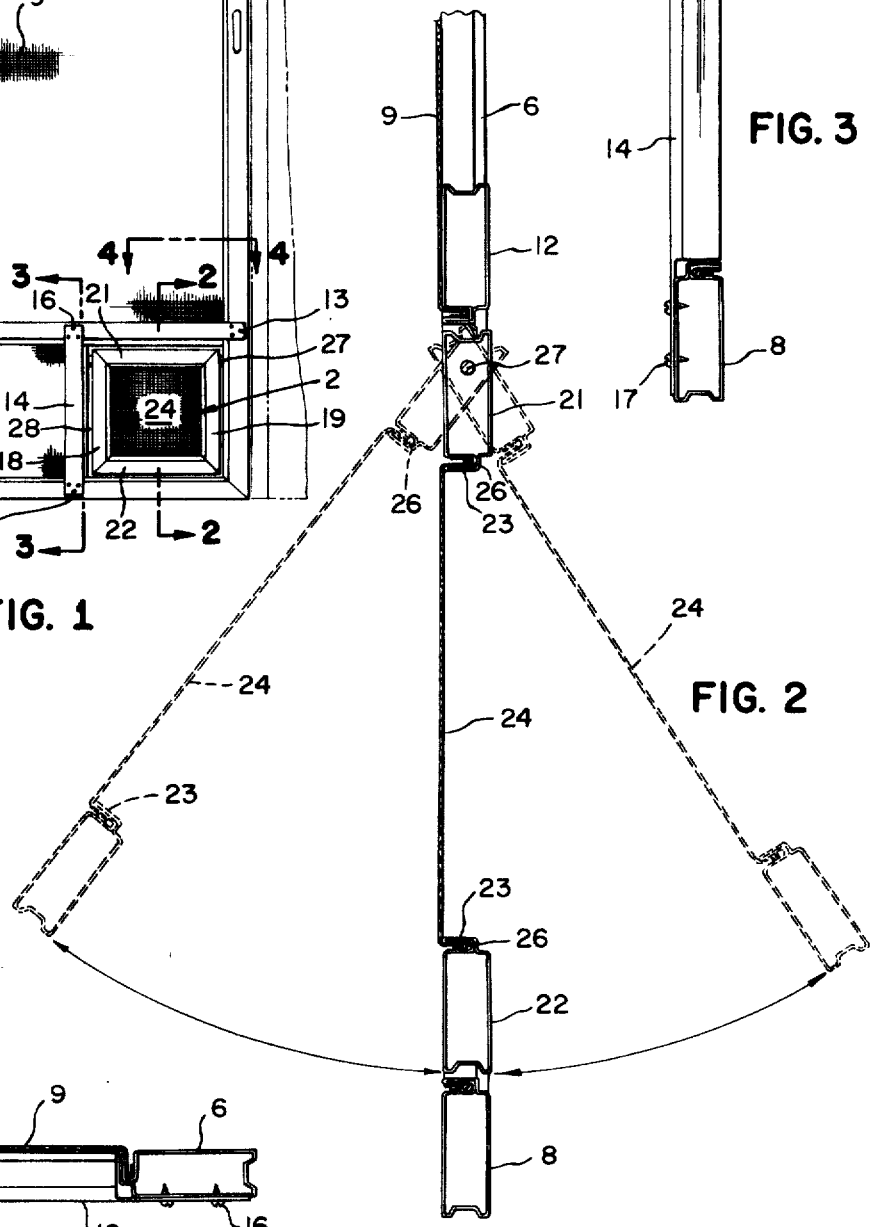
FIG. 2 is a fragmentary vertical sectional view taken in the plane indicated by the line 2—2 in FIG. 1.
Figure 4:
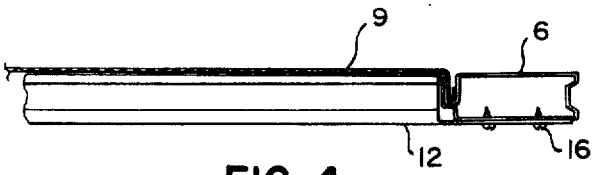
FIG. 4 is a fragmentary horizontal sectional view taken in the plane indicated by the line 4—4 in FIG. 1.

It is noted that since most commercially manufactured screen doors are manufactured with the screen intact, the auxiliary animal access door of the invention may be easily superimposed over such a primary screen door before the access opening is cut in the screen 9. Once the kit assembly has been positioned as illustrated in FIG. 1, and has been attached by use of the sheet metal screws 13, 16 and 17, as illustrated in FIG. 4, and the auxiliary access door assembly has been mounted on the primary screen door, the portion of the screen that lies immediately adjacent or opposite to the auxiliary access door is removed by cutting the screen along the vertical member 14 which is provided with an appropriate flange 28 into which the cut vertical edge of the screen may be tucked and sealed by an appropriate resilient seal strip similar to the resilient seal strip 26. In like manner, the screen 9 is cut parallel to the rail 12 immediately adjacent the edge thereof which is also provided with a seal flange 29 (FIG. 3) which forms a channel with the adjacent rail 12 and into which the edge portion 31 of the screen is tucked and secured by an appropriate seal strip 32.

It will thus be seen that the auxiliary animal access door assembly is easily applied to an already fabricated primary screen door of whatever design, to facilitate the passage of animals into and out of a house equipped with such a primary screen door. The auxiliary animal access door 2 fits snugly within the aperture provided for it, so that the intended function of the primary screen door, namely, to keep out flying insects, functions just as well with the auxiliary animal access door in position as it would otherwise.

Having thus described the invention what is claimed to be new and novel and sought to be protected by letters patent of the United States is as follows.

I claim:

1. A combination animal access door and screen door for a human habitat, comprising:

a primary screen door including top and bottom transversely extending horizontal rails connected at opposite ends by first and second longitudinally extending vertical side rails, said top, bottom and side rails defining an opening covered by a screen material; and an auxiliary screen door assembly in said primary screen door and comprising an elongated transversely extending horizontal top mounting rail having opposite ends attached to said first and second side rails of said primary screen door intermediate said top and bottom rails, a vertical rail disposed intermediate said side rails of said primary screen door, said vertical rail having its upper end attached to said top mounting rail and having its lower end attached to said bottom rail of said primary screen door, said top rail and said vertical rail cooperating with portions of said first side rail and said bottom rail of said primary screen door to define an animal access opening in said primary screen door, an animal access door comprising a generally quadrilateral frame covered by a screen material, pivot means for mounting said access door in said access opening, said pivot means comprising rod means mounted at the top of said quadrilateral frame and journalled in said vertical rail and said first side rails to define a horizontal pivot axis for said access door, whereby said access door normally is suspended from said pivot means in the plane of said primary screen door to close said access opening, said pivot means permitting pivotal motion of said access door out of its normal plane in opposite directions to permit the passage of an animal therethrough in either direction.

* * * * *